US012710040B1

(12) United States Patent
Sidorovich Paradiso et al.

(10) Patent No.: US 12,710,040 B1
(45) Date of Patent: Aug. 18, 2026

(54) ROTARY PUMP WITH TELESCOPING ROTOR SECTIONS THAT VARY THE FLOW RATE

(71) Applicant: PRATT & WHITNEY CANADA CORP., Longueuil (CA)

(72) Inventors: Ivan Sidorovich Paradiso, Longueuil (CA); Gabriel St-Laurent, Longueuil (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 19/080,078

(22) Filed: Mar. 14, 2025

(51) Int. Cl.
*F04C 2/22* (2006.01)
*F04C 14/18* (2006.01)

(52) U.S. Cl.
CPC ..... *F04C 2/22* (2013.01); *F04C 14/18* (2013.01); *F04C 14/185* (2013.01); *F04C 2240/20* (2013.01); *F04C 2240/50* (2013.01); *F04C 2250/20* (2013.01)

(58) Field of Classification Search
CPC ..... F04C 2/22; F04C 14/18; F04C 14/185; F04C 2240/20; F04C 2240/50; F04C 2250/20
See application file for complete search history.

(56) References Cited

U.S. PATENT DOCUMENTS 1,797,905 A * 3/1931 Dooley ..... F04C 14/185 418/28
3,107,047 A 10/1963 Albert
3,162,139 A 12/1964 Thompson
4,551,080 A * 11/1985 Geiger ..... F04C 14/185 418/28
5,738,065 A * 4/1998 Linnel ..... F01C 1/22 418/28

FOREIGN PATENT DOCUMENTS

CN 110131094 A 8/2019
DE 102010034896 B3 7/2011
EP 0034524 B1 * 8/1985 ..... F04C 18/22
WO 0011321 A1 3/2000

* cited by examiner

*Primary Examiner* — Mary A Davis
(74) *Attorney, Agent, or Firm* — NORTON ROSE FULBRIGHT CANADA LLP

(57) ABSTRACT

A pump for an aircraft engine, has: a housing including a static wall, a peripheral wall extending around an axis, and a movable wall movable along the axis in sealing contact with the peripheral wall, the static wall, the peripheral wall and the movable wall defining therebetween a rotor cavity communicating with an inlet and an outlet of the housing; an input shaft extending through the housing; a rotor drivingly engaged by the input shaft and movably contained within the rotor cavity, the rotor having two sections axially telescopically connected to one another and both extending between two apexes; an actuator operatively connected to the movable wall and operable to displace the movable wall relative to the static wall; and a biasing member operatively connected to the two sections of the rotor to bias the two sections away from one another to follow a movement of the movable wall.

20 Claims, 7 Drawing Sheets

ROTARY PUMP WITH TELESCOPING ROTOR SECTIONS THAT VARY THE FLOW RATE

TECHNICAL FIELD

The disclosure relates generally to aircraft engines and, more particularly, to fluid systems, such as fuel systems, and pumps used in fluid systems of such engines.

BACKGROUND

Aircraft engines have fluid systems, such as fuel systems configured for injecting a fuel flow from a tank to injectors. These fuel systems include pumps for driving the fuel flow from the tank. The fuel flow varies greatly with operating conditions of the aircraft engines, such as idle to take-off. Existing pumps are satisfactory, but there remains a need for improvements.

SUMMARY

In one aspect, there is provided a pump for an aircraft engine, comprising: a housing including a static wall, a peripheral wall extending from the static wall around an axis, and a movable wall movable along the axis towards and away from the static wall, the movable wall in sealing contact with the peripheral wall, the static wall, the peripheral wall and the movable wall defining therebetween a rotor cavity communicating with an inlet and an outlet of the housing; an input shaft extending through the housing and parallel to the axis; a rotor drivingly engaged by the input shaft and movably contained within the rotor cavity of the housing for orbital revolutions around the axis, the rotor having two sections axially telescopically connected to one another and both extending between two apexes in sealing contact with the peripheral wall of the housing; an actuator operatively connected to the movable wall of the housing and operable to displace the movable wall along the axis and relative to the static wall; and a biasing member operatively connected to the two sections of the rotor to bias the two sections away from one another to follow a movement of the movable wall.

The pump described above may include any of the following features, in any combinations.

In some embodiments, the two sections include a male section and a female section each defining a respective one of two rotor end walls, the male section defining a first male curved wall and a second male curved wall both extending between the two apexes, the female section defining a first female curved wall and a second female curved wall both extending between the two apexes, the first female curved wall defining a slot, the first male curved wall slidably received within the slot.

In some embodiments, the first male curved wall has a thickness being less than that of the second male curved wall such that a distance between the two apexes is constant along an axial height of the rotor relative to the axis.

In some embodiments, an outer face of the first female curved wall and an outer face of the second male curved wall are flush at the two apexes.

In some embodiments, bearings are disposed between two end walls of the rotor and both of the movable wall and the static wall of the housing.

In some embodiments, the bearings are balls rollingly received within grooves defined by the two end walls.

In some embodiments, the movable wall defines an annular groove, a sealing member received within the annular groove, the sealing member abutting the peripheral wall of the housing.

In some embodiments, the housing further include a cover located opposite the static wall, the movable all movable towards and away from the cover.

In some embodiments, the actuator is located between the cover and the movable wall.

In another aspect, there is provided an aircraft engine comprising: a thermal engine drivingly engaging an engine shaft; and a fluid system for circulating a fluid to a component, the fluid system having a pump fluidly connecting a reservoir of the fluid to the component, the pump having: a housing having an inlet fluidly connected to the reservoir and an outlet fluid connected to the component, the housing including a static wall, a peripheral wall extending from the static wall around an axis, and a movable wall in sealing contact with the peripheral wall, the static wall, the peripheral wall and the movable wall defining a rotor cavity therebetween, the rotor cavity fluidly connected to the inlet and the outlet; a rotor drivingly engaged by the engine shaft and movably contained within the rotor cavity for orbital revolutions around the axis, the rotor having two sections axially movable relative to one another and both extending between two apexes in sealing contact with the peripheral wall of the housing during the orbital revolutions, the rotor having a volume being variable with movements of the two sections relative to one another; an actuator operatively connected to the movable wall of the housing and operable to displace the movable wall along the axis and relative to the static wall; and a biasing member operatively connected to the two sections of the rotor to bias the two sections away from one another to follow a movement of the movable wall.

The aircraft engine described above may include any of the following features, in any combinations.

In some embodiments, a controller is operatively connected to the actuator, the controller having a processing unit and a computer-readable medium operatively connected to the processing unit and having instructions stored thereon executable by the processing unit to: determine that a flow rate of the fluid outputted by the pump is different than a desired flow rate of the component; and adjust the flow rate of the fluid outputted by the pump to reach the desired flow rate by causing the actuator to move the movable wall of the housing to vary a volume of the rotor cavity.

In some embodiments, the two sections include a male section and a female section each defining an end wall of the rotor, the male section defining a first male curved wall and a second male curved wall both extending between the two apexes, the female section defining a first female curved wall and a second female curved wall both extending between the two apexes, the first female curved wall defining a slot, the first male curved wall slidably received within the slot.

In some embodiments, the first male curved wall has a thickness being less than that of the second male curved wall such that a distance between the two apexes is constant along an axial height of the rotor relative to the axis.

In some embodiments, an outer face of the first female curved wall and an outer face of the second male curved wall are flush at the two apexes.

In some embodiments, bearings are disposed between end walls of the rotor and both of the movable wall and the static wall of the housing.

In some embodiments, the bearings are balls rollingly received within grooves defined by the end walls.

In some embodiments, the movable wall defines an annular groove, a sealing member received within the annular groove, the sealing member abutting the peripheral wall of the housing.

In some embodiments, the housing includes a cover located opposite the static wall, the movable all movable towards and away from the cover.

In some embodiments, the actuator is located between the cover and the movable wall.

In yet another aspect, there is provided a pump for an aircraft engine, comprising: a housing defining an inlet and an outlet, the housing having walls enclosing a rotor cavity communicating with the inlet and the outlet, the walls including a static wall, a peripheral wall extending around an axis, and a movable wall in sealing contact with the peripheral wall; an input shaft extending through the housing and parallel to the axis; a rotor drivingly engaged by the input shaft and movably contained within the rotor cavity of the housing for orbital revolutions around the axis, the rotor having two end rotor walls and a peripheral rotor wall extending between the two rotor end walls, the rotor having two apexes sealingly contacting the peripheral wall of the housing during the orbital revolutions, the rotor having two sections movable relative to one another to vary a distance between the two rotor end walls; and means for moving the movable wall away from the static wall and for expanding or contracting the rotor with movement of the movable wall.

DESCRIPTION OF THE DRAWINGS

Reference is now made to the accompanying figures in which.

DETAILED DESCRIPTION

Figure 1:
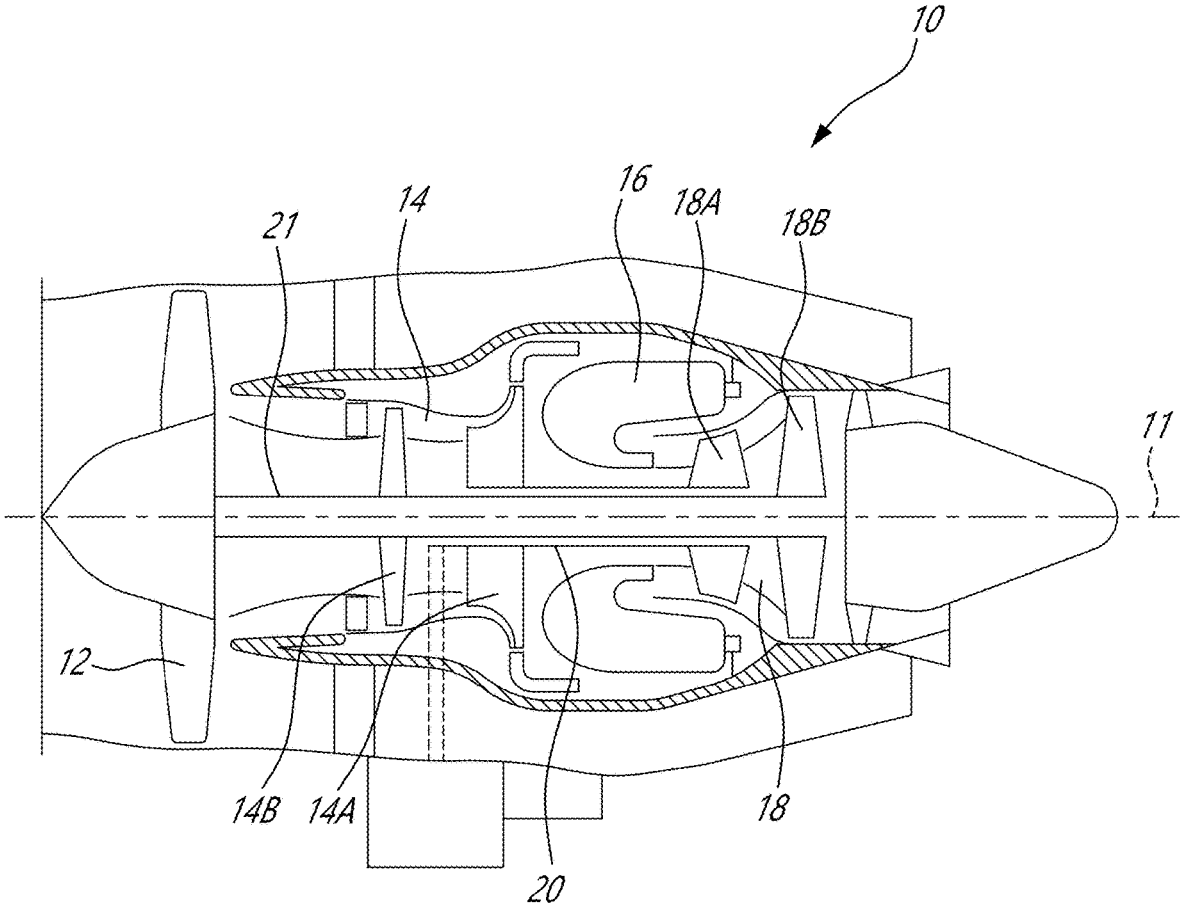
FIG. 1 is a schematic cross-sectional view of an aircraft engine depicted as a gas turbine engine.

FIG. 1 illustrates an aircraft engine depicted as a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The fan 12, the compressor section 14, and the turbine section 18 are rotatable about a central axis 11 of the gas turbine engine 10. In the embodiment shown, the gas turbine engine 10 comprises a high-pressure spool having a high-pressure shaft 20 drivingly engaging a high-pressure turbine 18A of the turbine section 18 to a high-pressure compressor 14A of the compressor section 14, and a low-pressure spool having a low-pressure shaft 21 drivingly engaging a low-pressure turbine 18B of the turbine section to a low-pressure compressor 14B of the compressor section 14 and drivingly engaged to the fan 12. It will be understood that the contents of the present disclosure may be applicable to any suitable engines, such as turboprops and turboshafts, and reciprocating engines, such as piston and rotary engines without departing from the scope of the present disclosure.

Figure 2:
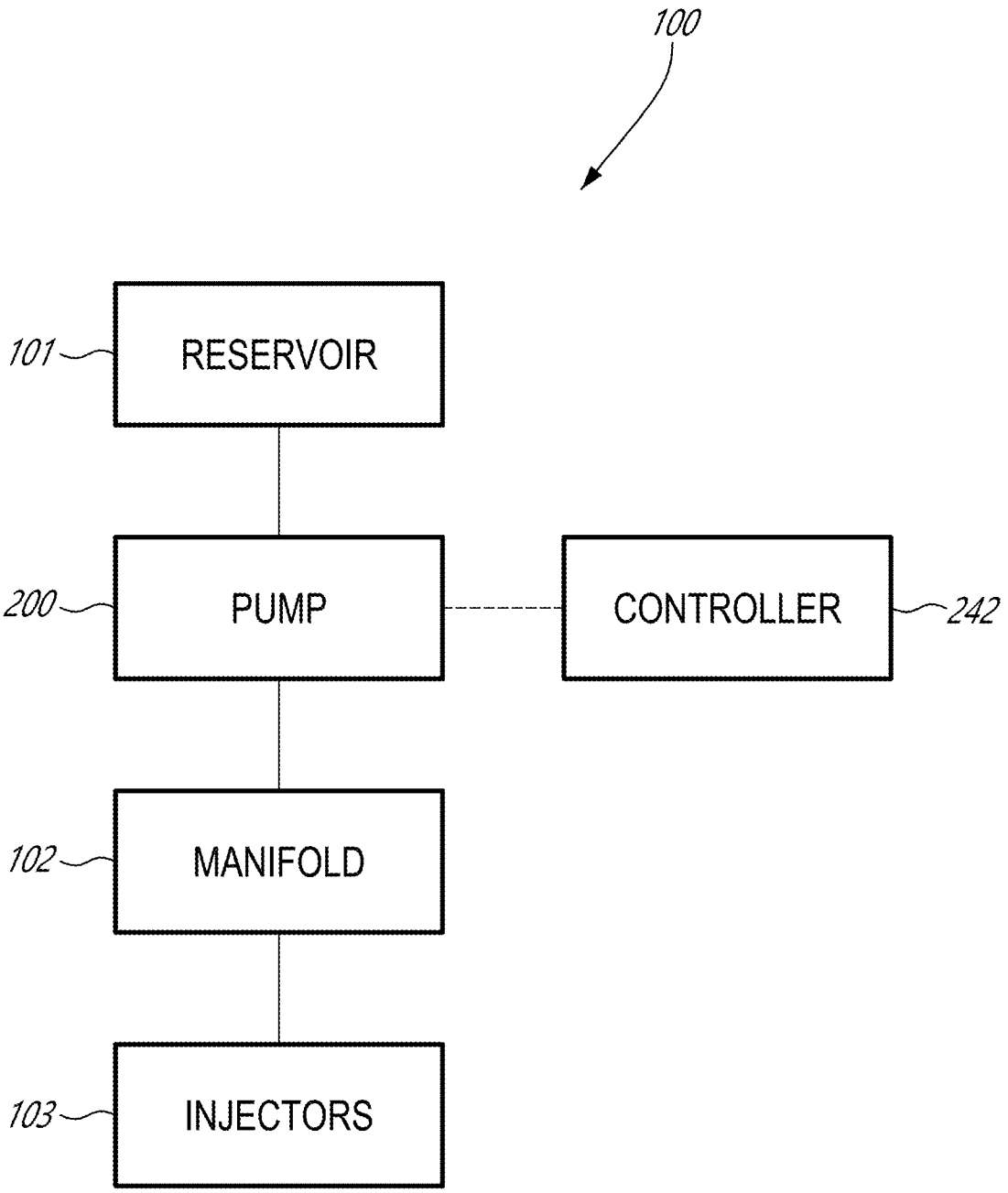
FIG. 2 is a schematic view of a fluid system being depicted as a fuel system of the gas turbine engine of FIG. 1.
Figure 3:
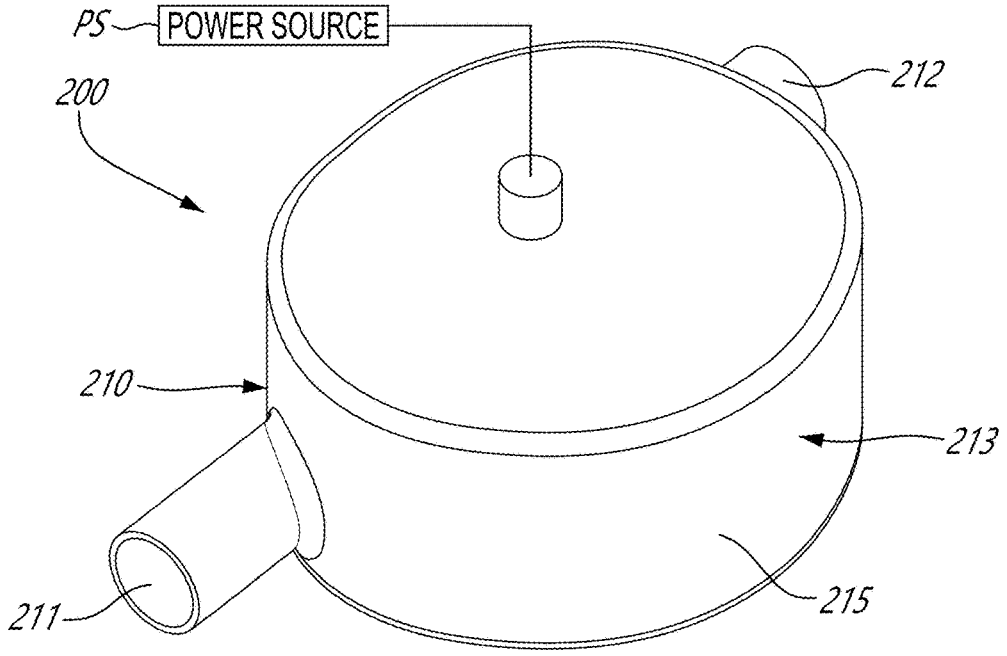
FIG. 3 is a three dimensional view of a pump of the fuel system of FIG. 2.

Referring to FIG. 2, the gas turbine engine 10 has a fuel system 100 configured for injecting fuel in to the combustor 16. The fuel system 100 includes a reservoir 101 containing a volume of fuel to be burned, a pump 200 for driving a fuel flow from the reservoir 101, and a manifold 102 receiving the fuel flow from the reservoir 101. The manifold 101 has a fuel inlet and a plurality of fuel outlets. Each of the fuel outlets of the manifold 102 is fluidly connected to a respective one of a plurality of injectors 103 for injecting the fuel in the combustor 16 (FIG. 1). It will be appreciated that the principles of the present disclosure may apply to any fluid systems of the gas turbine engine 10, such as an oil system.

In some cases, it is challenging to control the fuel flow between the different operating conditions of the gas turbine engine 10, such as ground idle and take-off. The fuel flow at take-off is substantially greater than that at idle. Inconsistencies in the fuel flow may cause fluctuations in the combustion efficiency. For instance, changes in pressure or temperature of the fuel at the inlet of the pump 200 may impact the fuel flow, which then impacts an air/fuel ratio inside the combustion chamber. Moreover, some pumps may face pressure drop issues caused by, for example, obstructions that increase resistance, cause turbulence, and so on. High back pressure from the combustor may also have an impact. Some existing pumps may be subjected to wear, and may require frequent maintenance and calibration.

Referring now to FIGS. 3-6, the pump 200 that may at least partially alleviate some of the aforementioned drawbacks is shown and described below.

The pump 200 has a housing 210 defining an inlet 211 fluidly connected to the reservoir 101 (FIG. 2) and an outlet 212 fluid connected to the manifold 102 (FIG. 2), or to any component that receives the fluid that flows through the pump 200. The housing 210 has walls 213 enclosing a rotor cavity 221 communicating with the inlet 211 and the outlet 212. The walls 213 include a static wall 214, a peripheral wall 215 extending from the static wall 214 around an axis A1, and a movable internal partition or movable wall 216 in opposed facing relationship with the static wall 214 and in sealing contact with an inner surface of the peripheral wall 215. The walls 213 further include a cover 217 located on a side of the movable wall 216 opposite to the static wall 214. The movable wall 216 is axially movable along axis A1 towards and away from the cover 217.

Figure 4:
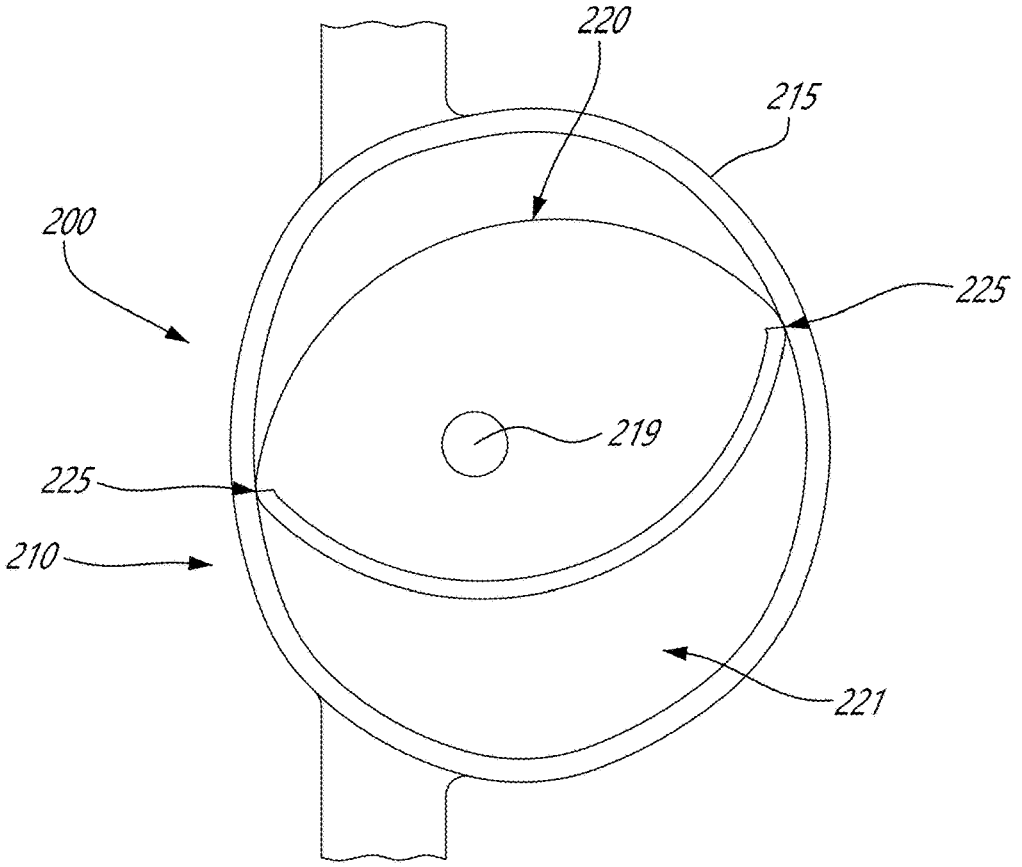
FIG. 4 is a cutaway view of the pump of FIG. 3 along a plane normal to an axis of rotation of a rotor of the pump.

As shown more distinctly in FIG. 4, the peripheral wall 215 has a non-circular shape. The shape of the peripheral wall 215 may be referred to has hypotrochoidal. The shape may be referred to as elliptical or ovoid. As shown in FIG.

5, the housing 210 defines axially aligned apertures 218 through the static wall 214, the movable wall 216, and the cover 217. These apertures 218 are coincident with the axis A1 of the housing 210 and are sized to receive a shaft 219 used to provide motive power to the pump 200. The shaft 219 of the pump 200 may be drivingly engaged by any suitable power source PS such as an electric motor, an actuator, a shaft of the gas turbine engine 10, and so on.

As shown in FIG. 4, the pump 200 includes a rotor 220 drivingly engaged by the shaft 219 and movably contained within the rotor cavity 221 of the housing 210 between the static wall 214 and the movable wall 216. During operation, the rotor 220 performs orbital revolutions around the axis A1. In so doing, the rotor 220 defines chambers of variable volume that induce fluid displacement from the inlet 211 to the outlet 212. The rotor 220 is engaged to an eccentric portion of the shaft 219 to perform the orbital revolutions within the rotor cavity 221. The rotor 220 has a rotor axis that is offset from and parallel to the axis A1 of the housing 210. During each orbital revolution, each chamber defined between the rotor 220 and the peripheral wall 215 of the housing 210 varies in volume and moves around the rotor cavity 221.

Referring to FIGS. 4-7, the rotor 220 has two rotor end walls 223 and a peripheral rotor wall 224 extending between the two rotor end walls 223. Each of the two rotor end walls 223 (FIG. 7) face a respective one of the static wall 214 and the movable wall 216 of the housing 210. The rotor 220 has two apexes 225 (FIG. 4) sealingly contacting the peripheral wall 215 of the housing 210 during the orbital revolutions. In the context of the present disclosure, "sealing contact" implies that the apexes 225 are gliding against the peripheral wall 215 of the housing 210 during the orbital revolutions to limit leakage of the fluid between the apexes 225 and the peripheral wall 215. In some embodiments, apex seals may be used. These apex seals may be sealing strips received within grooves defined in the apexes 225. Biasing members may be disposed within those grooves to bias the sealing strips outwardly in contact against the peripheral wall 215 of the housing 210. Both of the two apexes 225 are constantly or in permanent contact against the peripheral wall 215 of the housing 210 during the orbital revolutions. Although not shown in the drawings, the rotor 220 defines a central bore sized to receive the shaft 219 therethrough. An internal gear is disposed within the central bore of the rotor 220 and sized to receive a gear mounted to the shaft 219. The internal gear is meshed with the gear of the shaft 219 and has a greater diameter (e.g., greater number of teeth) than the gear of the shaft 219 to create the orbital revolution.

Figure 5:
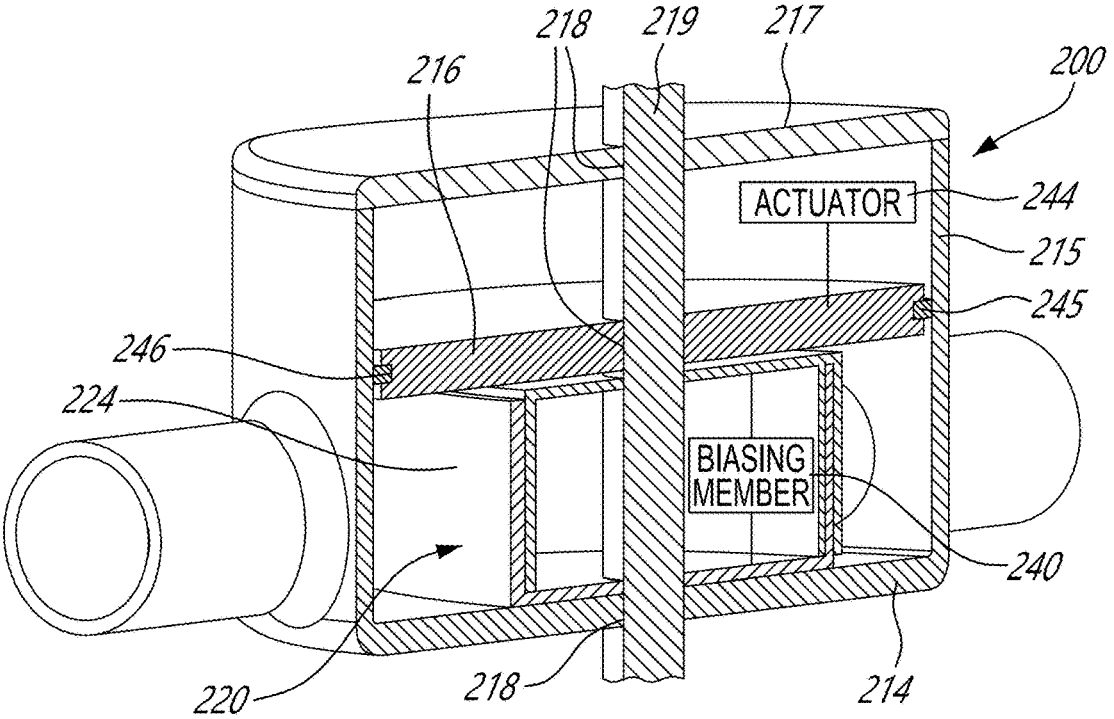
FIG. 5 is another three dimensional cutaway view of the pump of FIG. 3 taken along a plane parallel to the axis of rotation of the rotor illustrating the pump in a first possible configuration.
Figure 6:
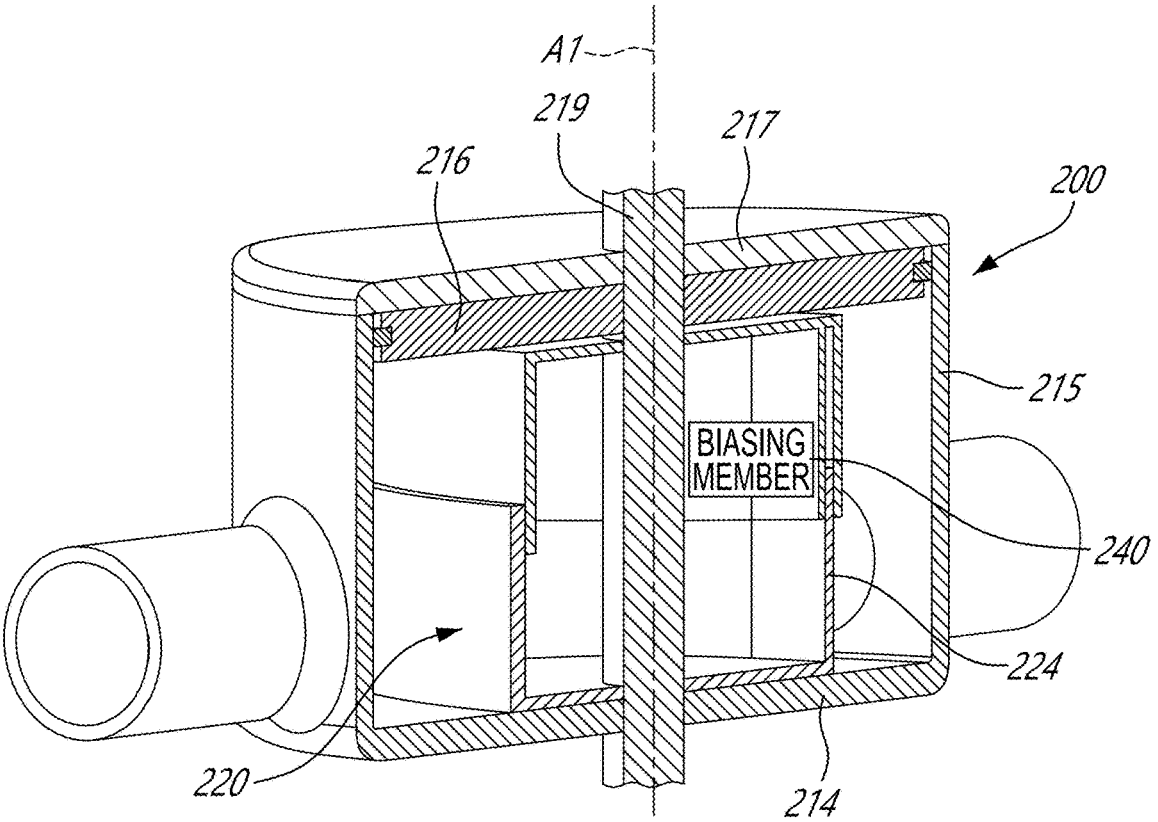
FIG. 6 is another three dimensional cutaway view of the pump of FIG. 3 taken along a plane parallel to the axis of rotation of the rotor illustrating the pump in a second possible configuration.

Referring now more specifically to FIGS. 5-6, an internal view of the pump 200 is shown and illustrates the pump 200 in two different configurations each associated with a respective flow rate for a same rotational speed of the shaft 219. In FIG. 5, the movable wall 216 is closer to the static wall 214 than in FIG. 6. This implies that, for the same rotational speed of the shaft 219, the flow rate generated by the pump 200 in the configuration depicted in FIG. 6 is greater than the flow rate generated by the pump 200 in the configuration depicted in FIG. 5.

The disclosed pump 200 may be particularly useful for configurations in which the shaft 219 of the pump 200 is driven by the thermal engine itself. Hence, it may not be possible to control the rotational speed of the pump 200 independently of that of the thermal engine. Having the ability to vary a volume of the rotor 220, and of the rotor cavity 221, during use may ensure that the flow rate generated by the pump 200 corresponds to the desired flow rate. This may eliminate the requirement to have a bypass line around the pump 200 to recirculate an excess flow rate of the fluid outputted by the pump and not required by downstream components. Put differently, the fuel system depicted in FIG. 2 may be devoid of a bypass line extending in parallel to the pump 200.

As shown in FIGS. 5-6, the movable wall 216 defines an annular groove 246 sized to receive a sealing member 245 therein. The sealing member 245 is abutting the peripheral wall 215 of the housing 210. A spring or other biasing means may be used to bias the sealing member 245 against the peripheral wall 215 of the housing 210. The sealing member 245 allows axial movements of the movable wall 216 relative to the peripheral wall 215 of the housing 210 to vary the volume of the rotor cavity 221. Seals may be disposed between the shaft 219 peripheries of the apertures 218 defined through the walls of the housing 210.

An actuator 244 is used to axially reciprocate the movable wall 216 along axis A1 to adjust the volume of the rotor cavity 221. The actuator 244 is operatively connected to the movable wall 216 of the housing 210 and may be disposed between the cover 217 and the movable wall 216. Herein, the expression "operatively connected" is meant to encompass a direct engagement or an indirect engagement that is, via intermediary components. It may alternatively be located outside the housing 210. The actuator 244 is operable to displace the movable wall 216 along the axis A1 and relative to the static wall 214 so as to vary the volume of the rotor cavity 221. The actuator 244 may be any suitable actuator, such as a solenoid, a magnetic actuator, a linear actuator, a pneumatic actuator, a hydraulic actuator, and so on. The actuator 244 may be electric such as a stepper/servo actuator placed above the rotor 220. Magnetic levitation may be used to vary the size of the rotor 220.

Figure 7:
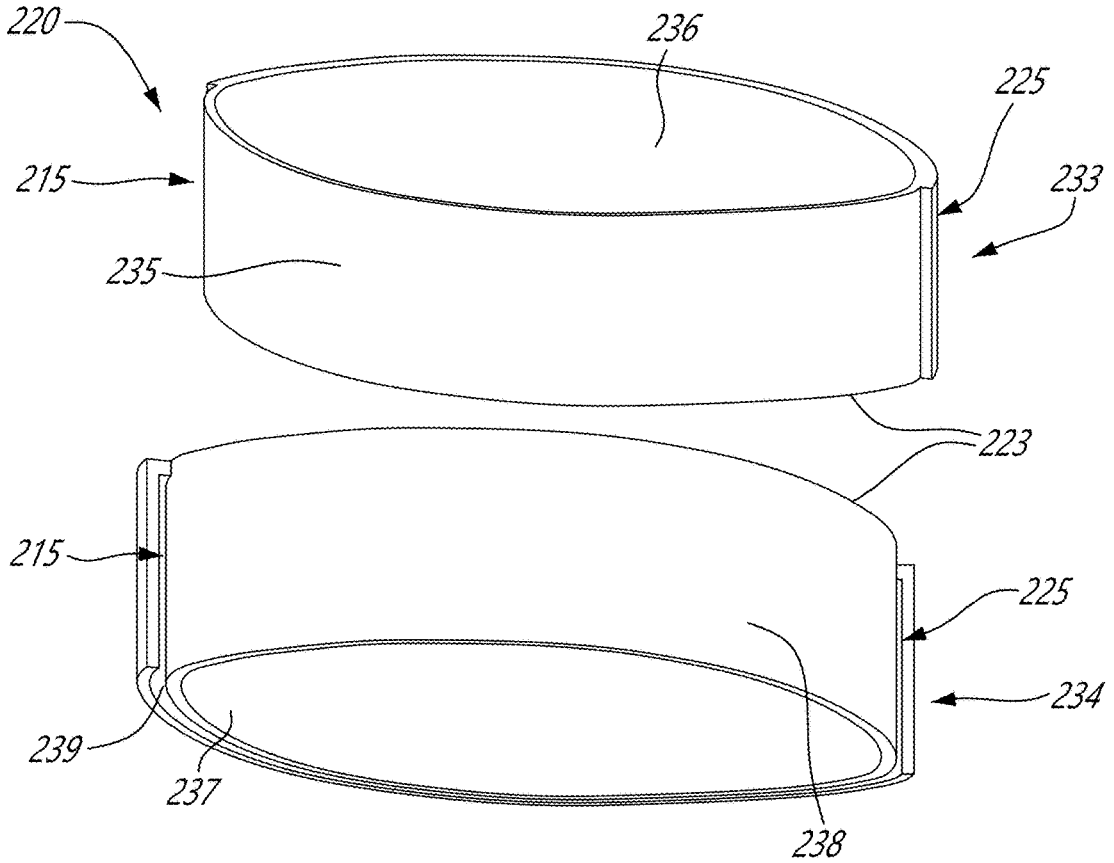
FIG. 7 is a three dimensional exploded view of the rotor of the pump of FIG. 3.
Figure 8:
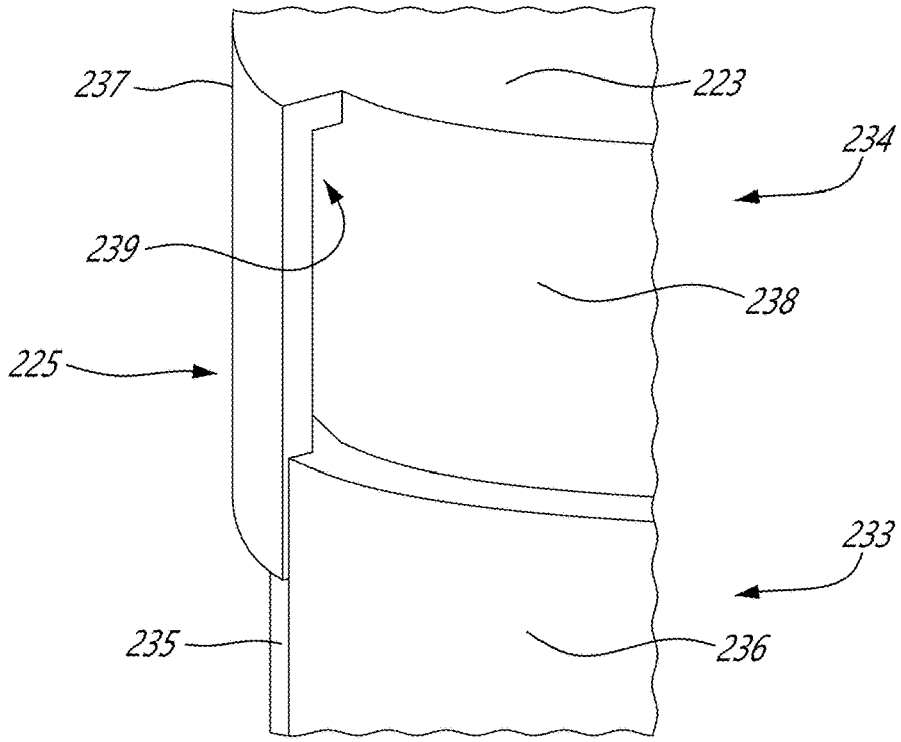
FIG. 8 is an enlarged view illustrating an apex of the rotor of the pump of FIG. 3.

Referring now to FIGS. 7-8, the rotor 220 is described in greater detail. As aforementioned, the volume of the rotor cavity 221 may be varied to change the flow rate of the pump 200. However, a volume of the rotor 220 is also variable to follow the change of volume of the rotor cavity 221. In some embodiments, the rotor 220 has two sections movable relative to one another to vary a distance between the two rotor end walls 223. In other words, the rotor 220 has two sections telescopically connected to one another to expand or retract the two sections to vary the volume of the rotor 220. Put differently, the rotor has a volume being variable with movements of the two sections relative to one another. The volume of the rotor increases when the two sections move away from one another and decreases when the two sections move towards one another.

The two sections include a male section 233 and a female section 234 each defining a respective one of the two rotor end walls 223. The male section 233 defines a first male curved wall 235 and a second male curved wall 236 both extending between the two apexes 225. Similarly, the female section 234 defines a first female curved wall 237 and a second female curved wall 238 both extending between the two apexes 225. The first female curved wall 237 defines a slot 239 sized to slidably receive therein the first male curved wall 235.

As shown in FIG. 8, the first male curved wall 235 has a thickness being less than that of the second male curved wall 236 such that a distance between the two apexes 225 is constant along an axial height of the rotor 220 relative to the axis A1. In other words, an outer face of the first male curved wall 235 is recessed inwardly relative to an outer face of the second male curved wall 236. This allows the penetration of the first male curved wall 235 into the slot 239 of the first female curved wall 237, but also ensures that the outer face of the second male curved wall 236 is flush with an outer face of the first female curved wall 237 at the two apexes 225. This provides a continuity into an outer face of the rotor 220 at the two apexes 225 to maintain a contact sealing line with the peripheral wall 215 of the housing 210. The contact sealing line limits leakage of the fluid around the two apexes 225. As shown in FIG. 8, the contact sealing line has three portions: a first one defined solely by the first section of the rotor 220, a second one defined solely by the second section of the rotor 220, and a third or overlapping one defined conjointly by both of the two sections of the rotor 220. A size of the overlapping portion varies with an increase and decrease of the volume of the rotor 220.

As shown in FIG. 5, a biasing member 240 is operatively connected to the two sections 233, 234 to bias the two sections away from one another to follow a movement of the movable wall 216. The biasing member 240 may be any suitable biasing means such as a spring, a gas spring, a rubber spring. The biasing member 240 may alternatively be located between the movable wall 216 and the rotor 220 to exert a pulling force on one of the two rotor sections 233, 234.

Figure 9:
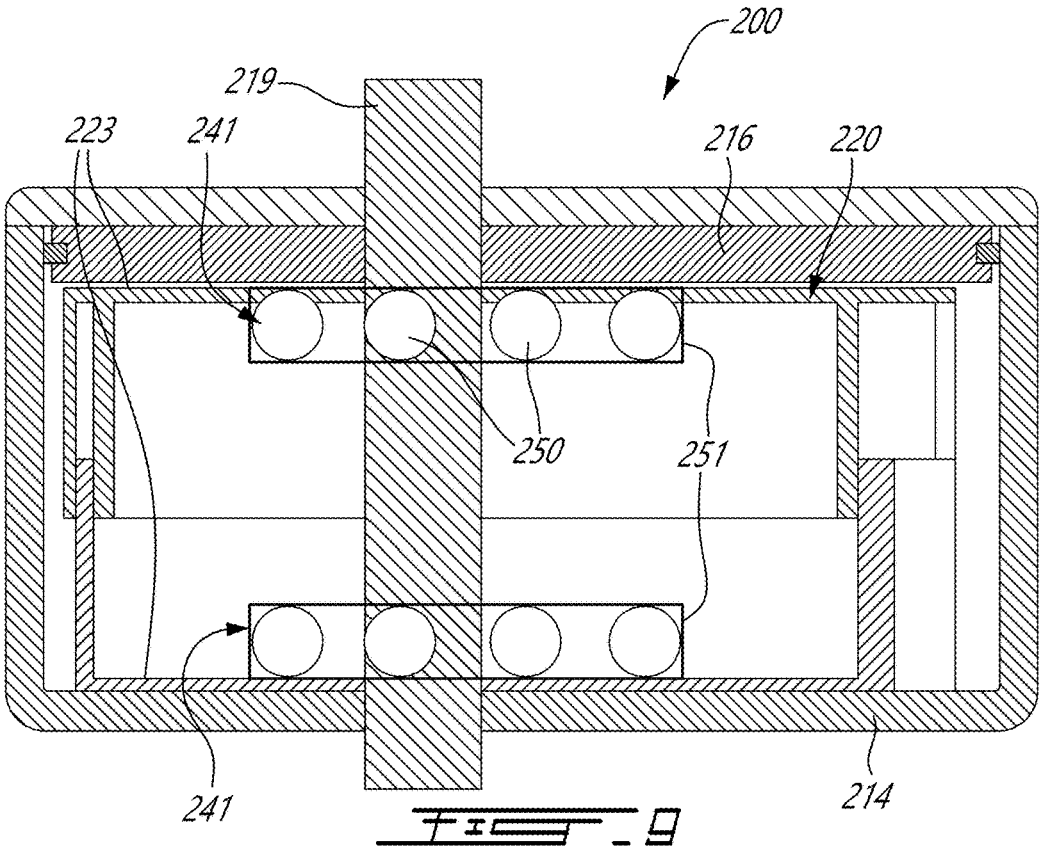
FIG. 9 is a cross-sectional view of the pump of FIG. 3 taken along a plane parallel to the axis of rotation.
Figure 10:
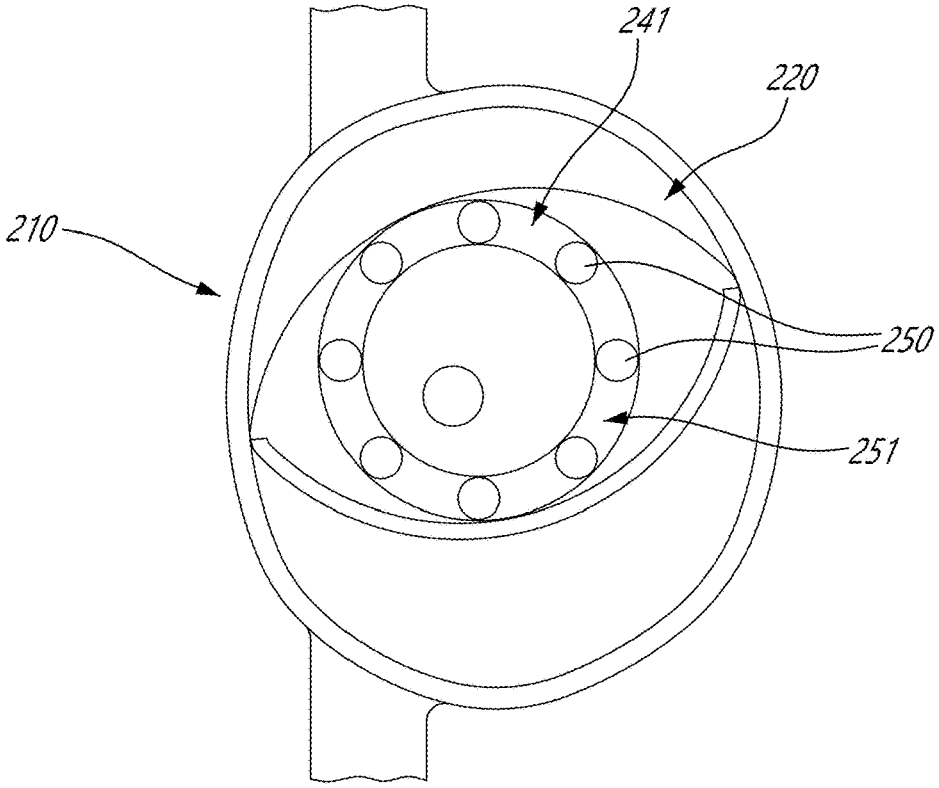
FIG. 10 is another cross-sectional view of the pump of FIG. 3 taken along a plane normal to the axis of rotation.

As shown in FIGS. 9-10, bearings 241 may be disposed between the two rotor end walls 223 and both of the movable wall 216 and the static wall 214 of the housing 210. The bearings 241 may be balls 250 rollingly received within grooves 251 defined by the two rotor end walls 223. The bearings 241 may be buried inside the rotor 220. That is, they may be mechanically fixed to the rotor 220. The balls of the bearings 241 may allow the displacement of the rotor 220 relative to the housing 210 in two directions. A clearance between the rotor 220 and the housing 210 may be adjusted by varying an amount of exposure of the bearing 241. Other rolling means may be used in some embodiments. In some cases, the rotor 220 may be in sliding contact against the housing 210. Arc seals may be used for this purpose.

In some embodiments, a controller 242 (FIG. 2) may be operatively connected to the pump 200, more specifically to the actuator 244. The controller 242 is configured to determine that a flow rate of the fluid outputted by the pump 200 is different than a desired flow rate of the component; and cause the actuator 244 to move the movable wall 216 of the housing 210 to vary a volume of the rotor cavity 221 thereby modifying the flow rate of the fluid outputted by the pump 200 until the desired flow rate is reached. The determining of the flow rate of the fluid being above the desired flow rate may be determined using a sensor or other means. The sensor may be a pressure sensor. If more fuel is outputted than desired, the pressure at the outlet of the pump 200 is expected to increase. The controller 242 may detect the increase in the pressure and cause the pump 200 to reduce the volume of the rotor cavity 221 and of the rotor 220 to lower the flow rate until the pressure reaches a desired range. In some cases, a lookup table associating a power of the gas turbine engine 10 to a flow rate may be used. In such a case, the controller 242 would look in the table to determine the desired flow rate as a function of the power from a power level of the gas turbine engine 10 and adjust the volume of the rotor cavity/rotor accordingly. Other configurations are contemplated.

The pump 200 disclosed herein may provide some benefits. For instance, it has fewer moving parts than a gear pump, which may result in lower maintenance costs and increased reliability; it may be more compact than a gear pump for the same rating, its operation may be smoother thus generating a more uniform flow with less impulsion; it may be less prone to vibrations and noise than the gear pump; it may offer a greater flow capacity to deliver larger volumes of fuel or fluid more consistently; it may allow a continuous flow control; it may offer a steady pressure of the fluid delivered at a desired flow rate without fluctuations in the injectors; the variable displacement of the rotor 220 may allow to adjust the flow rate with each rotation of the rotor 220; and it may offer an adaptive operation by being able to adapt to changes of viscosity or other properties of the fluid flowing therethrough.

Figure 11:
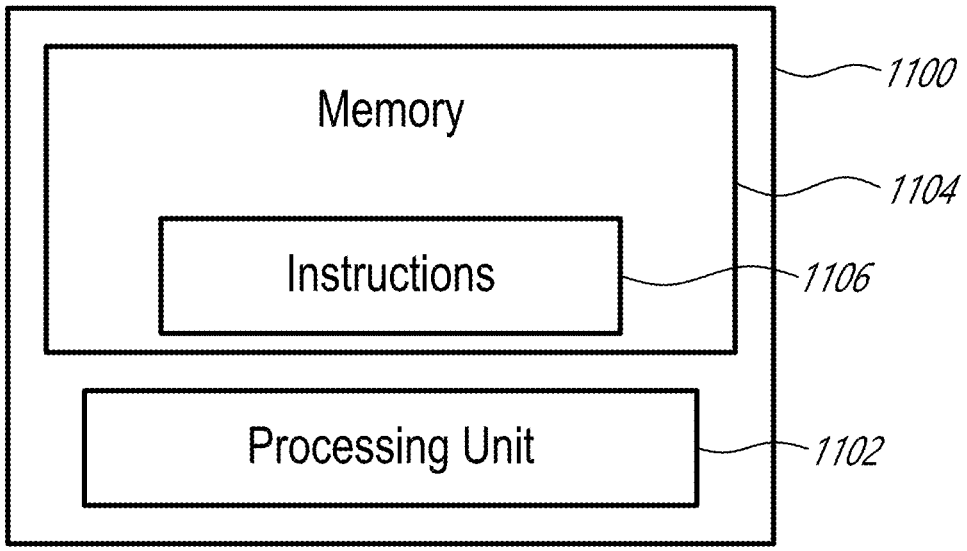
FIG. 11 is a schematic representation of a controller for the fluid system of FIG. 2.

With reference to FIG. 11, an example of a computing device 1100 is illustrated. For simplicity only one computing device 1100 is shown but the system may include more computing devices 1100 operable to exchange data. The computing devices 1100 may be the same or different types of devices. The controller 242 may be implemented with one or more computing devices 1100. Note that the controller 242 can be implemented as part of a full-authority digital engine controls (FADEC) or other similar device, including electronic engine control (EEC), engine control unit (ECU), electronic propeller control, propeller control unit, and the like. In some embodiments, the controller 242 is implemented as a Flight Data Acquisition Storage and Transmission system, such as a FAST™ system. The controller 242 may be implemented in part in the FAST™ system and in part in the EEC. Other embodiments may also apply.

The computing device 1100 comprises a processing unit 1102 and a memory 1104 which has stored therein computer-executable instructions 1106. The processing unit 1102 may comprise any suitable devices configured to implement the method described herein such that instructions 1106, when executed by the computing device 1100 or other programmable apparatus, may cause the functions/acts/steps performed as part of the method as described herein to be executed. The processing unit 1102 may comprise, for example, any type of general-purpose microprocessor or microcontroller, a digital signal processing (DSP) processor, a central processing unit (CPU), an integrated circuit, a field programmable gate array (FPGA), a reconfigurable processor, other suitably programmed or programmable logic circuits, or any combination thereof.

The memory 1104 may comprise any suitable known or other machine-readable storage medium. The memory 1104 may comprise non-transitory computer readable storage medium, for example, but not limited to, an electronic, magnetic, optical, electromagnetic, infrared, or semiconductor system, apparatus, or device, or any suitable combination of the foregoing. The memory 1104 may include a suitable combination of any type of computer memory that is located either internally or externally to device, for example random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like. Memory 1104 may comprise any storage means (e.g., devices) suitable for retrievably storing machine-readable instructions 1106 executable by processing unit 1102.

The methods and systems herein may be implemented in a high level procedural or object oriented programming or scripting language, or a combination thereof, to communicate with or assist in the operation of a computer system, for example the computing device 1100. Alternatively, the methods and systems described herein may be implemented in assembly or machine language. The language may be a compiled or interpreted language. Program code for implementing the methods and systems described herein may be stored on a storage media or a device, for example a ROM, a magnetic disk, an optical disc, a flash drive, or any other suitable storage media or device. The program code may be readable by a general or special-purpose programmable computer for configuring and operating the computer when the storage media or device is read by the computer to perform the procedures described herein. Embodiments of the methods and systems described herein may also be considered to be implemented by way of a non-transitory computer-readable storage medium having a computer program stored thereon. The computer program may comprise computer-readable instructions which cause a computer, or more specifically the processing unit 1102 of the computing device 1100, to operate in a specific and predefined manner to perform the functions described herein, for example those described in the method described herein.

Computer-executable instructions may be in many forms, including program modules, executed by one or more computers or other devices. Generally, program modules include routines, programs, objects, components, data structures, etc., that perform particular tasks or implement particular abstract data types. Typically the functionality of the program modules may be combined or distributed as desired in various embodiments.

The embodiments described herein are implemented by physical computer hardware, including computing devices, servers, receivers, transmitters, processors, memory, displays, and networks. The embodiments described herein provide useful physical machines and particularly configured computer hardware arrangements. The embodiments described herein are directed to electronic machines and methods implemented by electronic machines adapted for processing and transforming electromagnetic signals which represent various types of information. The embodiments described herein pervasively and integrally relate to machines, and their uses; and the embodiments described herein have no meaning or practical applicability outside their use with computer hardware, machines, and various hardware components. Substituting the physical hardware particularly configured to implement various acts for non-physical hardware, using mental steps for example, may substantially affect the way the embodiments work. Such computer hardware limitations are clearly essential elements of the embodiments described herein, and they cannot be omitted or substituted for mental means without having a material effect on the operation and structure of the embodiments described herein. The computer hardware is essential to implement the various embodiments described herein and is not merely used to perform steps expeditiously and in an efficient manner.

The term "connected" or "coupled to" may include both direct coupling (in which two elements that are coupled to each other contact each other) and indirect coupling (in which at least one additional element is located between the two elements).

The technical solution of embodiments may be in the form of a software product. The software product may be stored in a non-volatile or non-transitory storage medium, which can be a compact disk read-only memory (CD-ROM), a USB flash disk, or a removable hard disk. The software product includes a number of instructions that enable a computer device (personal computer, server, or network device) to execute the methods provided by the embodiments.

It is noted that various connections are set forth between elements in the preceding description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities. The term "connected" or "coupled to" may therefore include both direct coupling (in which two elements that are coupled to each other contact each other) and indirect coupling (in which at least one additional element is located between the two elements).

It is further noted that various method or process steps for embodiments of the present disclosure are described in the preceding description and drawings. The description may present the method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the description should not be construed as a limitation.

Furthermore, no element, component, or method step in the present disclosure is intended to be dedicated to the public regardless of whether the element, component, or method step is explicitly recited in the claims. As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

While various aspects of the present disclosure have been disclosed, it will be apparent to those of ordinary skill in the art that many more embodiments and implementations are possible within the scope of the present disclosure. For example, the present disclosure as described herein includes several aspects and embodiments that include particular features. Although these particular features may be described individually, it is within the scope of the present disclosure that some or all of these features may be combined with any one of the aspects and remain within the scope of the present disclosure. References to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. The use of the indefinite article "a" as used herein with reference to a particular element is intended to encompass "one or more" such elements, and similarly the use of the definite article "the" in reference to a particular element is not intended to exclude the possibility that multiple of such elements may be present.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

The invention claimed is:

1. A pump for an aircraft engine, comprising:

a housing including a static wall, a peripheral wall extending from the static wall around an axis, and a movable wall movable along the axis towards and away from the static wall, the movable wall in sealing contact with the peripheral wall;

the static wall, the peripheral wall, and the movable wall defining therebetween a rotor cavity communicating with an inlet and an outlet of the housing;

an input shaft extending through the housing and parallel to the axis;

a rotor drivingly engaged by the input shaft and movably contained within the rotor cavity of the housing for orbital revolutions around the axis, the rotor having two sections axially telescopically connected to one another and both extending between two apexes in sealing contact with the peripheral wall of the housing;

an actuator operatively connected to the movable wall of the housing and operable to displace the movable wall along the axis and relative to the static wall; and a biasing member operatively connected to the two sections of the rotor to bias the two sections away from one another to follow a movement of the movable wall.

2. The pump of claim 1, wherein the two sections include a male section and a female section each defining a respective one of two rotor end walls, the male section defining a first male curved wall and a second male curved wall both extending between the two apexes, the female section defining a first female curved wall and a second female curved wall both extending between the two apexes, the first female curved wall defining a slot, the first male curved wall slidably received within the slot.

3. The pump of claim 2, wherein the first male curved wall has a thickness being less than that of the second male curved wall such that a distance between the two apexes is constant along an axial height of the rotor relative to the axis.

4. The pump of claim 3, wherein an outer face of the first female curved wall and an outer face of the second male curved wall are flush at the two apexes.

5. The pump of claim 1, comprising bearings disposed between two end walls of the rotor and both of the movable wall and the static wall of the housing.

6. The pump of claim 5, wherein the bearings are balls rollingly received within grooves defined by the two end walls.

7. The pump of claim 1, wherein the movable wall defines an annular groove, a sealing member received within the annular groove, the sealing member abutting the peripheral wall of the housing.

8. The pump of claim 1, wherein the housing further include a cover located opposite the static wall, the movable wall movable towards and away from the cover.

9. The pump of claim 8, wherein the actuator is located between the cover and the movable wall.

10. An aircraft engine comprising:

a thermal engine drivingly engaging an engine shaft; and a fluid system for circulating a fluid to a component, the fluid system having a pump fluidly connecting a reservoir of the fluid to the component, the pump having:

a housing having an inlet fluidly connected to the reservoir and an outlet fluid connected to the component, the housing including a static wall, a peripheral wall extending from the static wall around an axis, and a movable wall in sealing contact with the peripheral wall;

the static wall, the peripheral wall, and the movable wall defining a rotor cavity therebetween, the rotor cavity fluidly connected to the inlet and the outlet;

a rotor drivingly engaged by the engine shaft and movably contained within the rotor cavity for orbital revolutions around the axis, the rotor having two sections axially movable relative to one another and both extending between two apexes in sealing contact with the peripheral wall of the housing during the orbital revolutions, the rotor having a volume being variable with movements of the two sections relative to one another;

an actuator operatively connected to the movable wall of the housing and operable to displace the movable wall along the axis and relative to the static wall; and a biasing member operatively connected to the two sections of the rotor to bias the two sections away from one another to follow a movement of the movable wall.

11. The aircraft engine of claim 10, comprising a controller operatively connected to the actuator, the controller having a processing unit and a computer-readable medium operatively connected to the processing unit and having instructions stored thereon executable by the processing unit to:

determine that a flow rate of the fluid outputted by the pump is different than a desired flow rate of the component; and adjust the flow rate of the fluid outputted by the pump to reach the desired flow rate by causing the actuator to move the movable wall of the housing to vary a volume of the rotor cavity.

12. The aircraft engine of claim 10, wherein the two sections include a male section and a female section each defining an end wall of the rotor, the male section defining a first male curved wall and a second male curved wall both extending between the two apexes, the female section defining a first female curved wall and a second female curved wall both extending between the two apexes, the first female curved wall defining a slot, the first male curved wall slidably received within the slot.

13. The aircraft engine of claim 12, wherein the first male curved wall has a thickness being less than that of the second male curved wall such that a distance between the two apexes is constant along an axial height of the rotor relative to the axis.

14. The aircraft engine of claim 12, wherein an outer face of the first female curved wall and an outer face of the second male curved wall are flush at the two apexes.

15. The aircraft engine of claim 10, comprising bearings disposed between end walls of the rotor and both of the movable wall and the static wall of the housing.

16. The aircraft engine of claim 15, wherein the bearings are balls rollingly received within grooves defined by the end walls.

17. The aircraft engine of claim 10, wherein the movable wall defines an annular groove, a sealing member received within the annular groove, the sealing member abutting the peripheral wall of the housing.

18. The aircraft engine of claim 10, wherein the housing includes a cover located opposite the static wall, the movable wall movable towards and away from the cover.

19. The aircraft engine of claim 18, wherein the actuator is located between the cover and the movable wall.

20. A pump for an aircraft engine, comprising:

a housing defining an inlet and an outlet, the housing having walls enclosing a rotor cavity communicating with the inlet and the outlet, the walls including a static wall, a peripheral wall extending around an axis, and a movable wall in sealing contact with the peripheral wall;

an input shaft extending through the housing and parallel to the axis;

a rotor drivingly engaged by the input shaft and movably contained within the rotor cavity of the housing for orbital revolutions around the axis, the rotor having two end rotor walls and a peripheral rotor wall extending between the two rotor end walls, the rotor having two apexes sealingly contacting the peripheral wall of the housing during the orbital revolutions, the rotor having two sections movable relative to one another to vary a distance between the two rotor end walls;

an actuator operatively connected to the movable wall for moving the movable wall relative to the static wall to vary a volume of the rotor with movement of the movable wall; and as biasing member for biasing the two sections of the rotor away from one another.

* * * * *